US009213309B2

(12) United States Patent
Makino et al.

(10) Patent No.: US 9,213,309 B2
(45) Date of Patent: Dec. 15, 2015

(54) IMAGE FORMING APPARATUS HAVING IMAGE FORMING UNIT

(71) Applicant: Brother Kogyo Kabushiki Kaisha, Nagoya-shi, Aichi-ken (JP)

(72) Inventors: Masato Makino, Kariya (JP); Kouji Watanabe, Gifu (JP); Nobuyuki Futatsuki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/525,608

(22) Filed: Oct. 28, 2014

(65) Prior Publication Data

US 2015/0117893 A1 Apr. 30, 2015

(30) Foreign Application Priority Data

Oct. 31, 2013 (JP) ..... 2013-227603
Oct. 31, 2013 (JP) ..... 2013-227604

(51) Int. Cl.
*G03G 21/20* (2006.01)
*G03G 21/16* (2006.01)

(52) U.S. Cl.
CPC ..... *G03G 21/206* (2013.01); *G03G 21/1619* (2013.01)

(58) Field of Classification Search
CPC ... G03G 21/206; G03G 15/751; G03G 21/20; G03G 15/00; G03G 21/203
USPC ..... 399/91
See application file for complete search history.

(56) References Cited

U.S. PATENT DOCUMENTS 7,484,722 B2 2/2009 Ishii
7,748,706 B2 7/2010 Ishii
7,995,948 B2 8/2011 Yano et al.
8,155,556 B2 4/2012 Moribe et al.

(Continued)

FOREIGN PATENT DOCUMENTS

JP H03-217861 A 9/1991
JP 2002-137493 A 5/2002

(Continued)

OTHER PUBLICATIONS

Apr. 10, 2015—(US) Non-Final Office Action—U.S. Appl. No. 14/538,304.

(Continued)

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus includes a casing, a cover unit, and a liquid channel. The cover unit is disposed above an image forming unit. The cover unit includes a first member, a second member, and a neighboring portion positioned between the first member and the second member. The liquid channel is configured to guide liquid and includes a first channel and a second channel. The first channel is disposed between the neighboring portion and the image forming unit. The first channel includes a recess part and a liquid outlet. The recess part is disposed below the neighboring portion and extending toward the frame in an extending direction. The liquid outlet is positioned at an end portion of the recess part in the extending direction. The second channel is disposed at the frame. The second channel is configured to allow liquid to pass through the frame in the extending direction.

20 Claims, 8 Drawing Sheets

(56) References Cited

U.S. PATENT DOCUMENTS

| | | | | |
|---|---|---|---|---|
| 8,204,401 | B2 | 6/2012 | Tsuchiya | |
| 2006/0008294 | A1 | 1/2006 | Ito et al. | |
| 2006/0269320 | A1 | 11/2006 | Ishii | |
| 2007/0002290 | A1 | 1/2007 | Muraki et al. | |
| 2007/0036604 | A1 | 2/2007 | Maekawa et al. | |
| 2008/0049260 | A1 | 2/2008 | Moribe et al. | |
| 2009/0116889 | A1 | 5/2009 | Ishii | |
| 2013/0272744 | A1* | 10/2013 | Wakayama et al. | 399/97 |

FOREIGN PATENT DOCUMENTS

| | | | |
|---|---|---|---|
| JP | 2002-182441 | A | 6/2002 |
| JP | 2002-351282 | A | 12/2002 |
| JP | 2005-018011 | A | 1/2005 |
| JP | 2006-053508 | A | 2/2006 |
| JP | 2006-337570 | A | 12/2006 |
| JP | 2007-062159 | A | 3/2007 |
| JP | 2007-292968 | A | 11/2007 |
| JP | 2008-052037 | A | 3/2008 |
| JP | 2009-169120 | A | 7/2009 |
| JP | 2009-169126 | A | 7/2009 |
| JP | 4826387 | B2 | 11/2011 |
| JP | 2008-0520387 | A | 10/2012 |
| JP | 2012-203989 | A | 10/2012 |

OTHER PUBLICATIONS

May 22, 2015—(US) Notice of Allowance—U.S. Appl. No. 14/547,608.

Jun. 23, 2015—(US) Notice of Allowance—U.S. Appl. No. 14/553,116.

* cited by examiner

IMAGE FORMING APPARATUS HAVING IMAGE FORMING UNIT

CROSS REFERENCE TO RELATED APPLICATION

This application claims priority from Japanese Patent Application No. 2013-227603 filed Oct. 31, 2013 and Japanese Patent Application No. 2013-227604 filed Oct. 31, 2013. The entire contents of these priority applications are incorporated herein by reference.

TECHNICAL FIELD

The present invention relates to an image-forming apparatus employing an electrophotographic system.

BACKGROUND

One electrophotographic image-forming apparatus disclosed in Japanese unexamined patent application publication No. 2006-53508 is a laser printer. The laser printer includes a body case having a cover portion for covering a top portion of the body case; a process cartridge that form toner image on recording paper and disposed in the body case; and a fixing unit that fixes the toner image formed on the recording paper.

SUMMARY

However, if the user of the laser printer having the above construction accidentally spills liquid onto the cover portion of the laser printer, the liquid may penetrate and flow into the body case through seams or junctures therein.

If a liquid penetrates the body case of the laser printer, the process cartridges, the fixing unit, and the like may become wet, resulting in malfunctions such as electrical short-circuits.

In view of the foregoing, it is an object of the present invention to provide an image forming apparatus capable of preventing an image-forming unit and the like in the image forming apparatus from becoming wet when liquid is spilled on the cover portion of the body case.

In order to attain the above and other objects, the invention provides an image forming apparatus that may include a casing, a cover unit, and a liquid channel. The casing may include a frame supporting an image forming unit configured to form an image on a recording medium. The cover unit may be disposed above the image forming unit and include a first member, a second member positioned adjacent thereto, and a neighboring portion positioned between the first member and the second member and over the image forming unit. The liquid channel may be configured to guide liquid that has entered the casing. The liquid channel may include a first channel and a second channel. The first channel may be disposed between the neighboring portion and the image forming unit and configured to receive liquid that has entered the casing through the neighboring portion and guide liquid to the frame. The first channel may include a recess part and a liquid outlet. The recess part may be disposed below the neighboring portion and extends toward the frame in an extending direction. The liquid outlet may be configured to discharge liquid from the recess part and positioned at an end portion of the recess part in the extending direction. The second channel may be disposed at the frame and configured to receive liquid from the first channel. The second channel may have a passage opening through the frame in the extending direction and configured to allow liquid discharged from the liquid outlet to pass through the frame in the extending direction.

DETAILED DESCRIPTION

1. Overall Structure of a Printer

Figure 1:
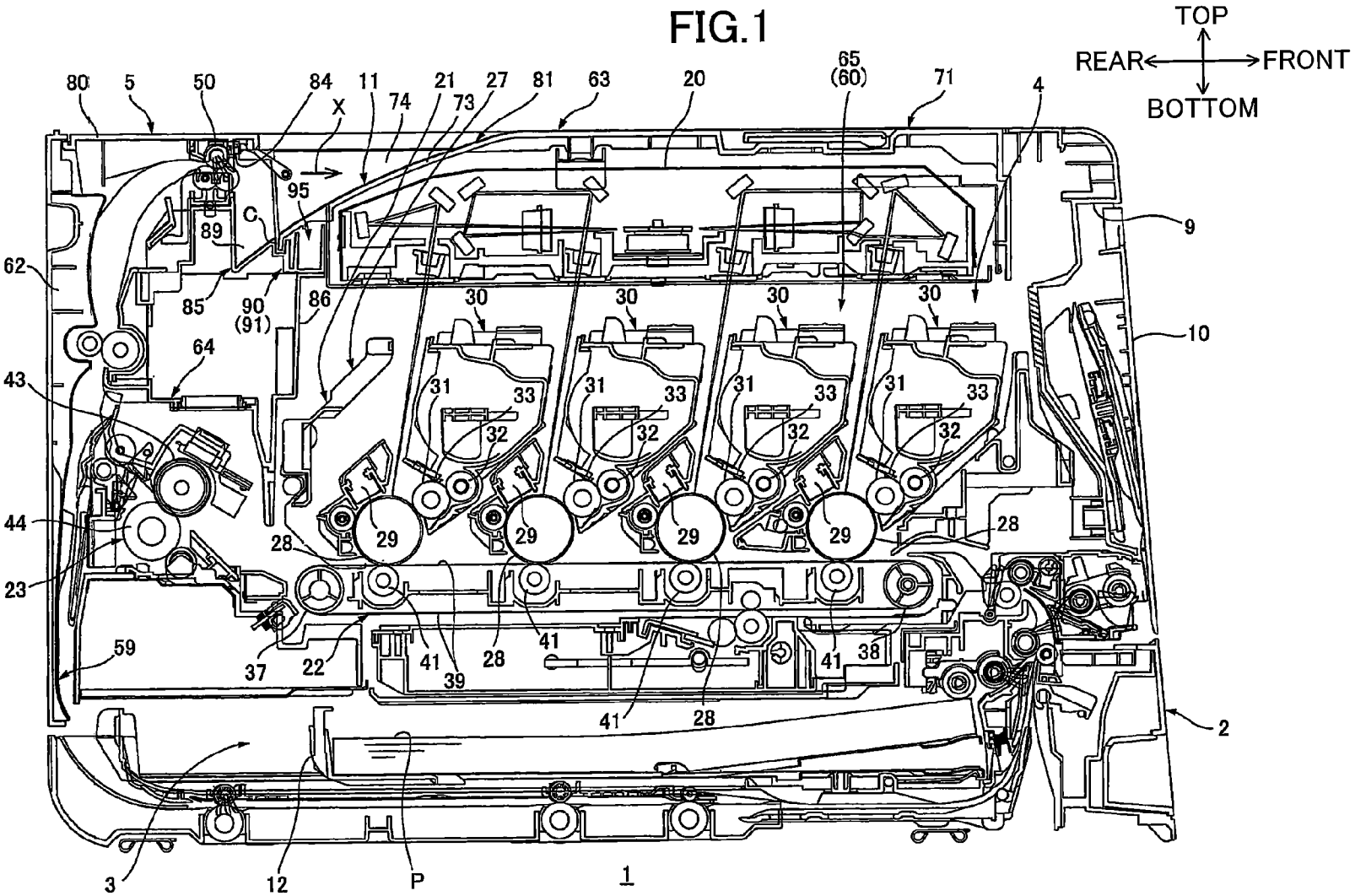
FIG. 1 is a central cross-sectional view of a printer as an example of an image forming apparatus according to an embodiment of the present invention.

FIG. 1 shows a printer 1 that is an example of the image-forming apparatus of the present invention. In the preferred embodiment, the printer 1 is a direct tandem color laser printer. The printer 1 includes a main casing 2, a sheet-feeding unit 3, an image-forming unit 4, and a sheet-discharge unit 5. The sheet-discharge unit 5 is an example of the discharge unit of the present invention.

The main casing 2 has a box-like shape and accommodates therein the sheet-feeding unit 3, the image-forming unit 4, and the sheet-discharge unit 5.

Directions in the following description related to the printer 1 will assume that the printer 1 is placed right side up on a level surface. Hence, the upper side of the printer 1 in FIG. 1 will be called the "top," and the lower side will be called the "bottom." Further, the right side of the printer 1 in FIG. 1 will be called the "front," and the left side will be called the "rear." Left and right sides of the printer 1 will be based on the perspective of a user facing the front of the printer 1. Therefore, the near side of the printer 1 in FIG. 1 will be called the "left side," and the far side will be called the "right side." The directions are indicated by arrows in each drawing. Further, the left-right direction is an example of the extending direction of the present invention. Further, the direction from the rear side toward the front side is an example of the discharge direction X of the present invention for discharging recording media.

The main casing 2 includes an access opening 9, a front cover 10, and a discharge tray 11 as an example of the tray unit of the present invention. The access opening 9 is provided on the front side of the main casing 2 and penetrates the front wall of the main casing 2 in the front-rear direction. The front cover 10 is pivotally movable about its bottom end portion in order to expose or cover the access opening 9. The discharge tray 11 is provided on the rear portion of a top wall 71 (described later) constituting the main casing 2. The discharge tray 11 is depressed downward from the top surface of the main casing 2 and functions to support sheets P of paper. The sheets P of paper are an example of the recording medium of the present invention.

The sheet-feeding unit 3 is adapted to convey the sheets P toward the image-forming unit 4. The sheet-feeding unit 3 includes a paper tray 12 detachably mounted in the bottom section of the main casing 2 and serves to accommodate therein the sheets P.

The image-forming unit 4 is configured to form images on the sheets P. The image-forming unit 4 includes a scanning unit 20, a process unit 21, a transfer unit 22, and a fixing unit 23.

The scanning unit 20 is disposed on the top portion of the main casing 2. The scanning unit 20 emits a laser beam for each of a plurality of photosensitive drums 28 (described later) based on image data in order to expose the photosensitive drums 28.

The process unit 21 is disposed beneath the scanning unit 20 in the approximate vertical center region of the main casing 2. The process unit 21 is capable of sliding along the front-rear direction and can be pulled out of the main casing 2 through the access opening 9. The process unit 21 includes a drawer unit 27, and developer cartridges 30.

The drawer unit 27 includes a plurality of photosensitive drums 28, and a plurality of scorotron chargers 29.

A plurality of the photosensitive drums 28 is provided to correspond to the plurality of colors of toner used by the printer 1. The photosensitive drums 28 are arranged parallel to each other and are spaced at regular intervals in the front-rear direction. More specifically, four photosensitive drums 28 are provided in the preferred embodiment to correspond to the four toner colors yellow, magenta, cyan, and black. The photosensitive drums 28 are arranged in this order from the front side of the drawer unit 27 toward the rear side thereof. Each photosensitive drum 28 has a general cylindrical shape and is elongated in the left-right direction. The photosensitive drums 28 are rotatably supported in the bottom of the drawer unit 27, with their bottom surfaces exposed from the bottom portion of the drawer unit 27.

A plurality of the scorotron chargers 29, and specifically four scorotron chargers 29 in the preferred embodiment, are provided to respectively correspond with the plurality of photosensitive drums 28. The scorotron chargers 29 are arranged at regular intervals so as to be positioned on the upper rear sides of corresponding photosensitive drums 28 with a gap therebetween.

A plurality of the developer cartridges 30, and specifically four of the developer cartridges 30 in the preferred embodiment, is provided to respectively correspond with the plurality of photosensitive drums 28. The developer cartridges 30 are detachably mounted in the drawer unit 27 on the upper sides of the corresponding photosensitive drums 28. Each developer cartridge 30 includes a developing roller 31, a supply roller 32, and a thickness-regulating blade 33.

The developing roller 31 is disposed in the bottom section of the corresponding developer cartridge 30. The developing roller 31 has a lower rear portion exposed through the developer cartridge 30 and contacts the upper front portion of the corresponding photosensitive drum 28. The supply roller 32 is disposed on the upper front side of the developing roller 31. The supply roller 32 has a lower rear surface in rolling contact with the upper front surface of the developing roller 31. The thickness-regulating blade 33 is disposed above the developing roller 31 and in sliding contact with the top surface of the developing roller 31. Each developer cartridge 30 accommodates therein toner for the corresponding color in a space above the supply roller 32.

The transfer unit 22 is disposed vertically between the paper tray 12 and the process unit 21 and is elongated in the front-rear direction. The transfer unit 22 includes a drive roller 37, a follow roller 38, a conveying belt 39, and transfer rollers 41. The drive roller 37 and the follow roller 38 are arranged parallel to each other and are spaced apart from each other in the front-rear direction. The conveying belt 39 is looped around the drive roller 37 and the follow roller 38. A plurality of the transfer rollers 41, and specifically four of the transfer rollers 41 in the preferred embodiment, is provided to correspond with the plurality of photosensitive drums 28. The transfer rollers 41 are disposed beneath the corresponding photosensitive drums 28 such that the upper portion of the conveying belt 39 is interposed between the transfer rollers 41 and the corresponding photosensitive drums 28.

The fixing unit 23 is positioned on the rear side of the transfer unit 22 with a gap therebetween. The fixing unit 23 includes a heating roller 43, and a pressure roller 44. The pressure roller 44 has an upper front surface in rolling contact with the lower rear surface of the heating roller 43 with pressure.

The sheet-discharge unit 5 is configured to discharge a sheet P from the main casing 2 after the image-forming unit 4 has formed an image on the sheet P. The sheet-discharge unit 5 is disposed above the fixing unit 23 and is provided with a discharge roller 50.

The discharge roller 50 is disposed rearward of the discharge tray 11 and is rotatably supported on the main casing 2.

The printer 1 having this construction performs an image-forming operation under the control of a control unit (not shown). At the beginning of the image-forming operation, the scorotron chargers 29 apply a uniform charge to the surfaces of the corresponding photosensitive drums 28. Next, the scanning unit 20 exposes the circumferential surfaces of the charged photosensitive drums 28 based on prescribed image data, thereby forming electrostatic latent images on the circumferential surfaces of each of the photosensitive drums 28 based on the image data.

Toner in each of the developer cartridges 30 is supplied to the corresponding supply rollers 32, and the supply rollers 32 in turn supply toner to the corresponding developing rollers 31. This toner is positively tribocharged between the supply rollers 32 and the developing rollers 31. Next, the thickness-regulating blades 33 regulate the toner carried on the surfaces of the corresponding developing rollers 31 at a uniform thickness. By rotating, the developing rollers 31 supply toner from their surfaces to the electrostatic latent images formed on the circumferential surfaces of the corresponding photosensitive drums 28, producing toner images on the circumferential surfaces of the photosensitive drums 28.

In the meantime, various rollers in the printer 1 rotate to feed sheets P from the paper tray 12 and to supply the sheets P one at a time onto the top portion of the conveying belt 39 at a prescribed timing. Subsequently, the conveying belt 39 conveys the sheet P supplied onto its top surface rearward so that the sheet P passes between each of the photosensitive drums 28 and the conveying belt 39. At this time, the photosensitive drums 28 and corresponding transfer rollers 41 sequentially transfer toner images in each color onto the sheet P conveyed therebetween, forming a color image on the sheet P.

After the color image has been formed on the sheet P, the circulation of the conveying belt 39 continues to convey the sheet P to a position between the heating roller 43 and the pressure roller 44. As the sheet P passes between the heating roller 43 and the pressure roller 44, the heating roller 43 and the pressure roller 44 apply heat and pressure to the sheet P to thermally fix the color image to the sheet P. Subsequently, the discharge roller 50 discharges the sheet P through a discharge opening 84 (described later) and onto the discharge tray 11 in a discharge direction X. Sheets P discharged from the main casing 2 are stacked on the top surface of a sheet support part 73 (described later) of the discharge tray 11 and supported thereby.

2. Detailed Description of the Main Casing

Figure 2A:
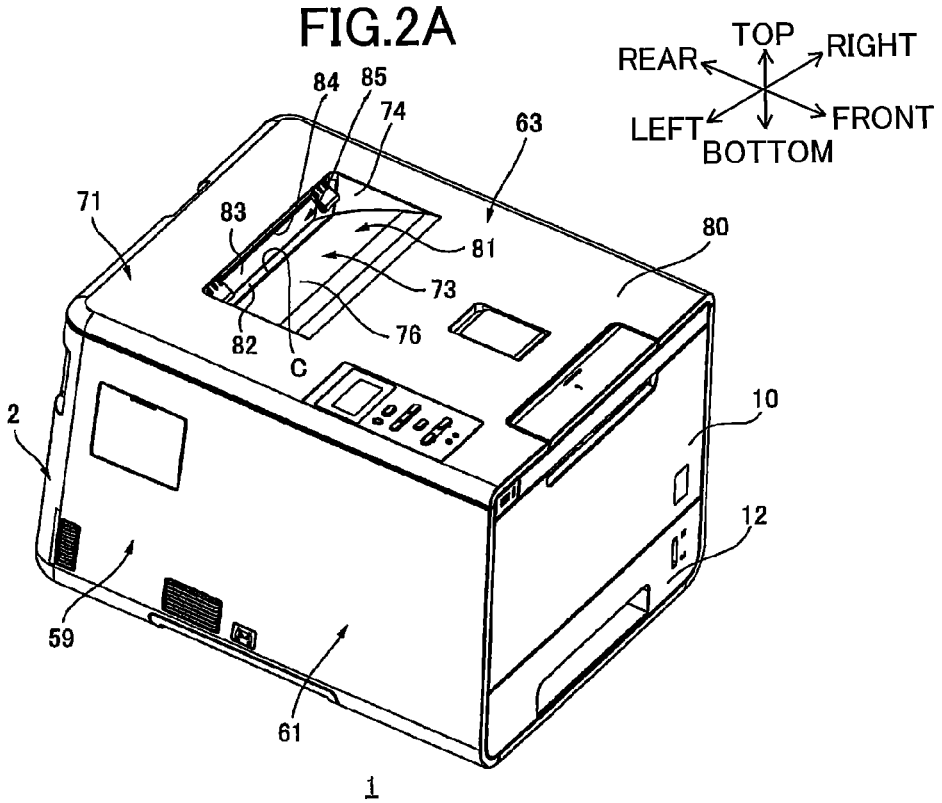
FIG. 2A is a perspective view of the printer shown in FIG. 1 as viewed from upper left according to the embodiment of the present invention.
Figure 2B:
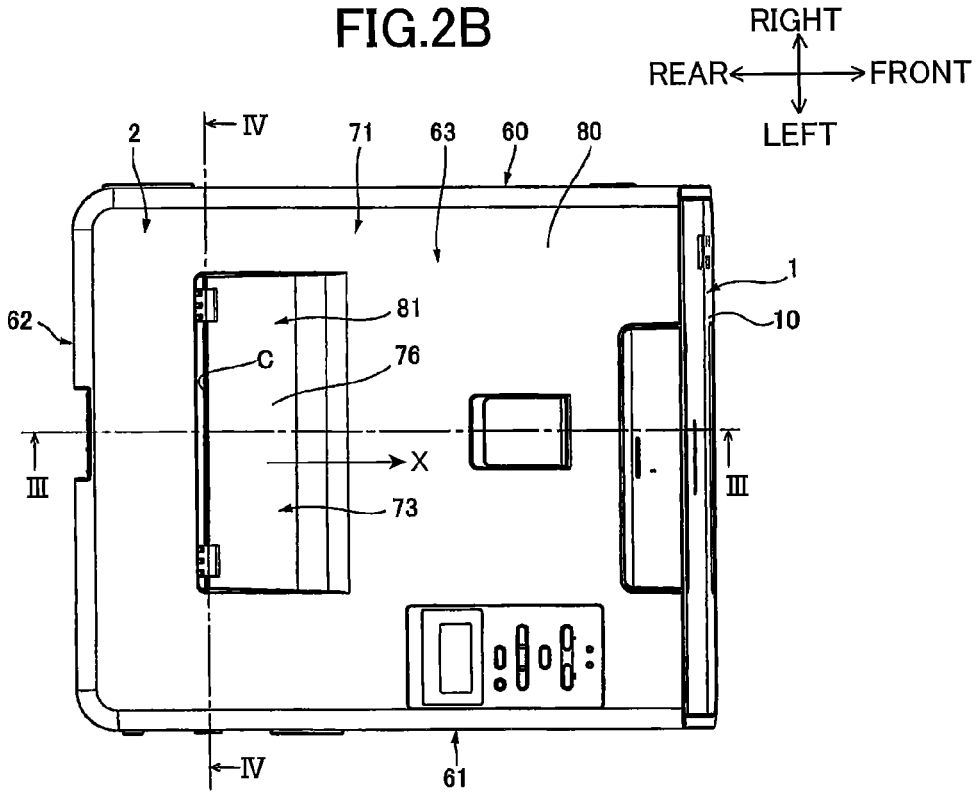
FIG. 2B is a plan view of the printer shown in FIG. 2A according to the embodiment of the present invention.

As shown in FIGS. 1, 2A, and 2B, the main casing 2 includes a main casing body 59 as an example of the casing of the present invention, and a top cover 63.

The main casing body 59 has a box-like shape with an opening upward. The main casing body 59 includes a right wall 60, a left wall 61, and a rear wall 62.

As shown in FIG. 1, the right wall 60 is disposed to the right of the image-forming unit 4 and constitutes the right side of the main casing body 59. The right wall 60 has a general rectangular shape in a side view and is elongated in the front-rear direction.

Figure 4:
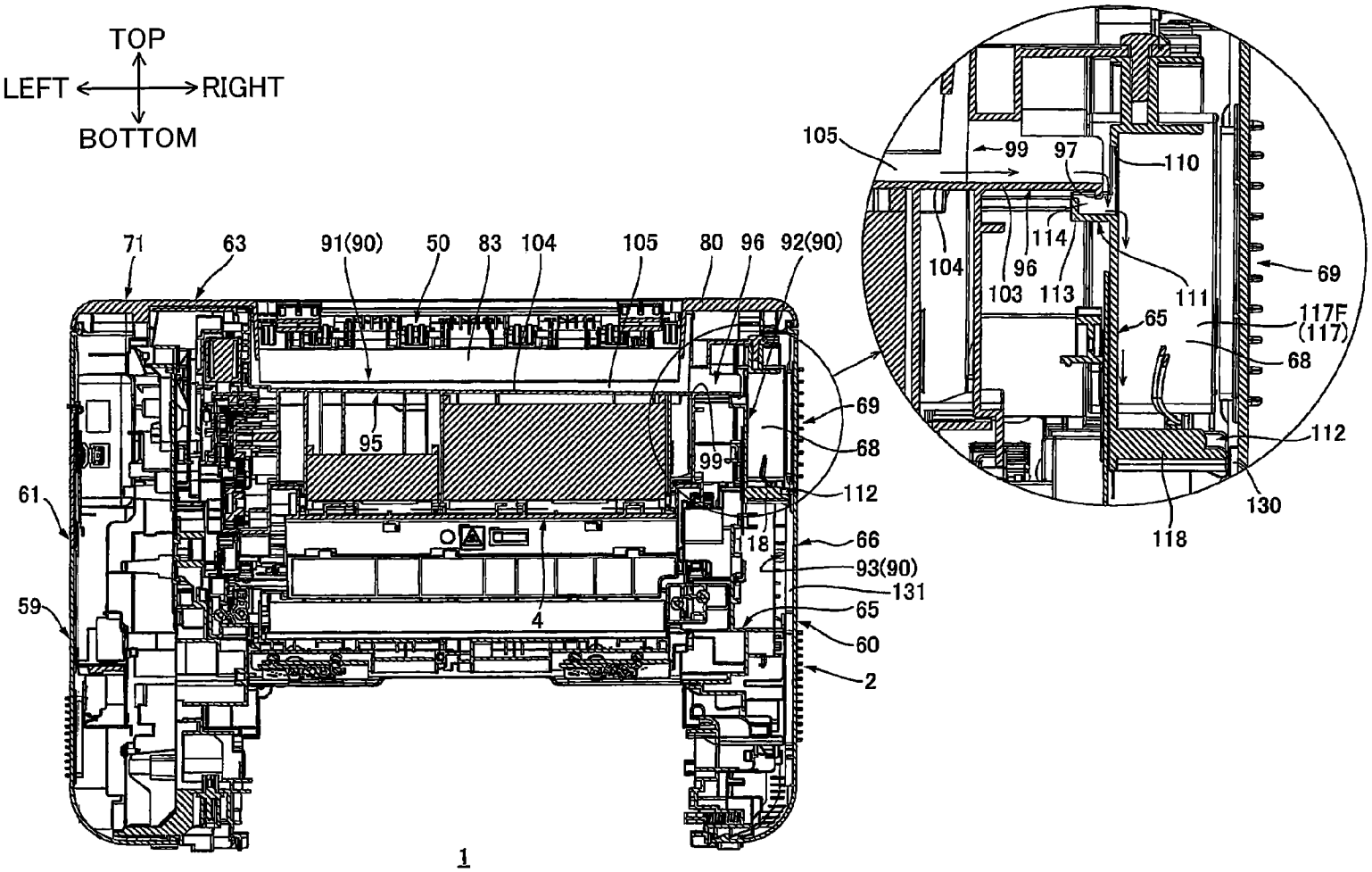
FIG. 4 is a cross-sectional view taken along the line IV-IV of FIG. 2B according to the embodiment of the present invention.

As shown in FIG. 4, the right wall 60 includes a frame 65, and a side cover 66 as an example of the cover of the present invention.

Figure 3:
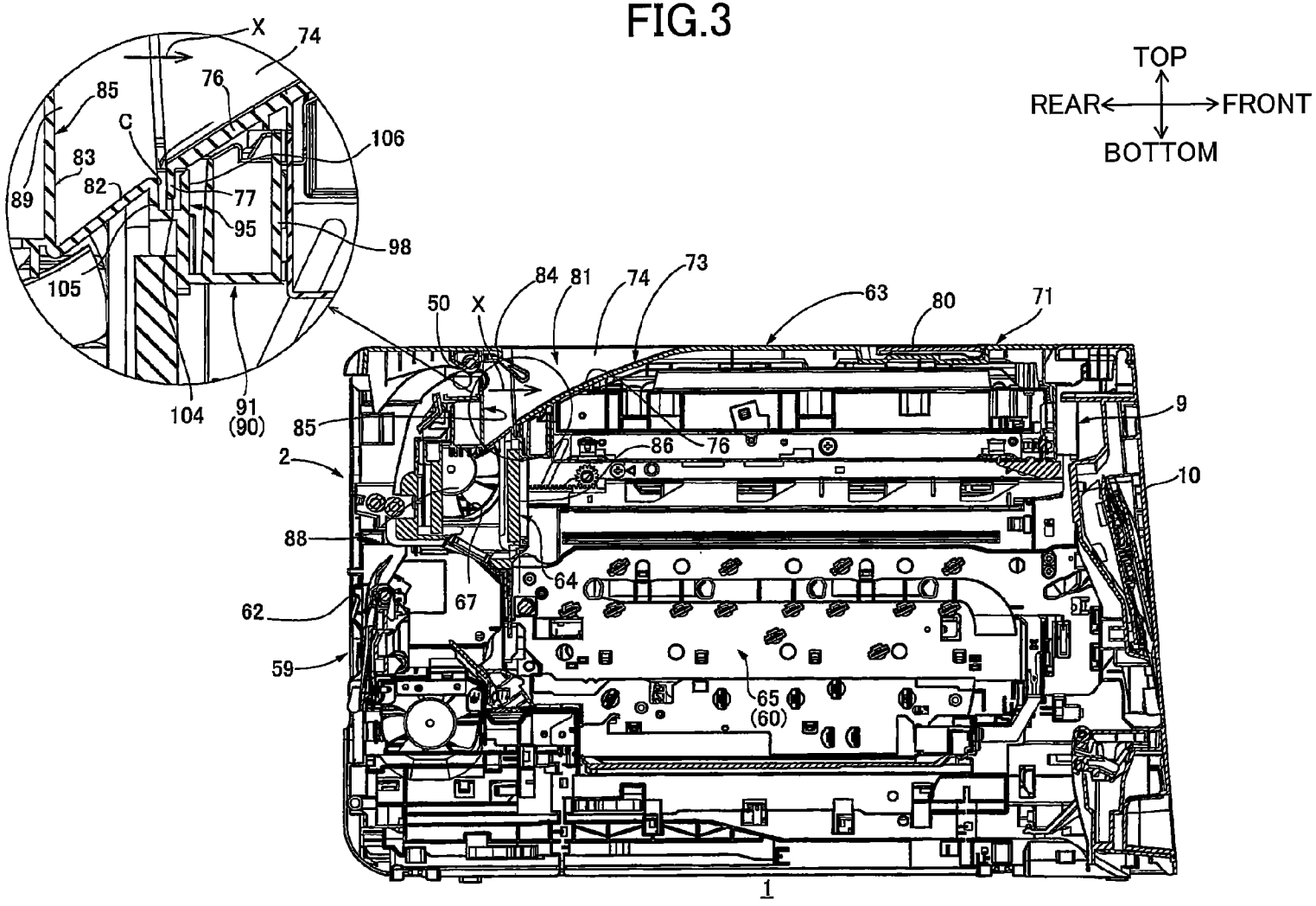
FIG. 3 is a cross-sectional view taken along the line III-III of FIG. 2B according to the embodiment of the present invention.
Figure 5:
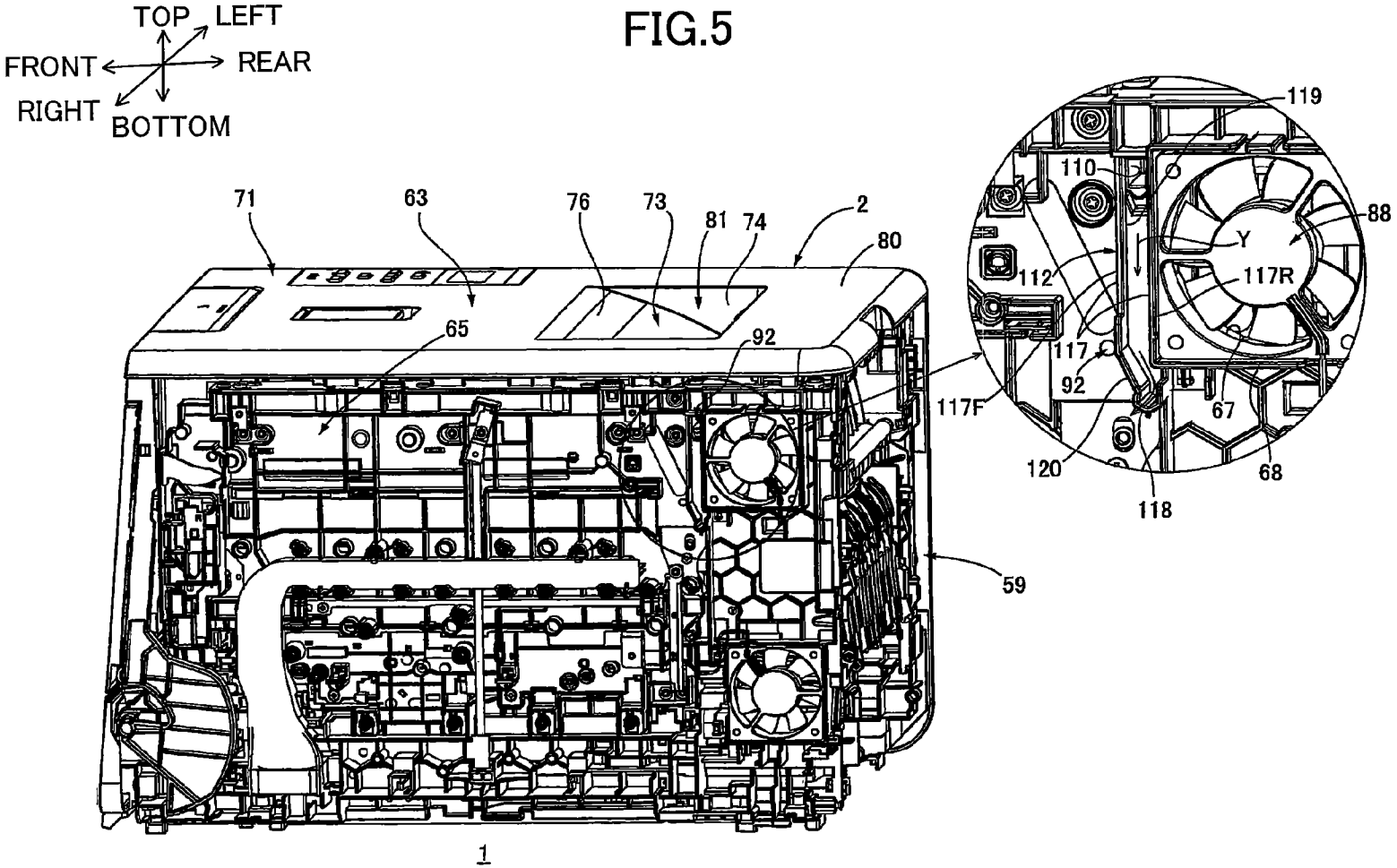
FIG. 5 is a perspective view of the printer without a side cover as viewed from rear right according to the embodiment of the present invention.

The frame 65 is disposed on the right side of the image-forming unit 4 and constitutes the left portion of the right wall 60. The frame 65 is formed of a resin material known in the art and has a plate shape that is generally rectangular in a side view and elongated in the front-rear direction, as illustrated in FIGS. 3 and 5. The frame 65 is formed with a through-hole 67 and has a fan support part 68.

As shown in FIG. 3, the through-hole 67 is formed at the upper portion of the frame 65 near the rear end portion thereof at a position corresponding to a fan 88 (described later). The through-hole 67 has a general circular shape in a side view and penetrates the frame 65 in the left-right direction.

As shown in FIG. 5, the fan support part 68 is disposed on the right surface of the frame 65 so as to surround the through-hole 67. The fan support part 68 has a general squared cylindrical shape that extends in the left-right direction so as to protrude rightward from the right surface of the frame 65. The front wall of the fan support part 68 constitutes a first guiding wall 117 described later.

As will be described later, the frame 65 is also integrally provided with a second channel 92.

As shown in FIG. 4, the side cover 66 constitutes the right side wall 60 and is disposed adjacent to the frame 65. The side cover 66 covers the right side of the frame 65 from rightward, i.e. from opposite side of the image-forming unit with respect to the frame 65. The side cover 66 is formed of a well-known resin material and is plate-shaped with a size and shape in a side view substantially the same as the frame 65.

Figure 6:
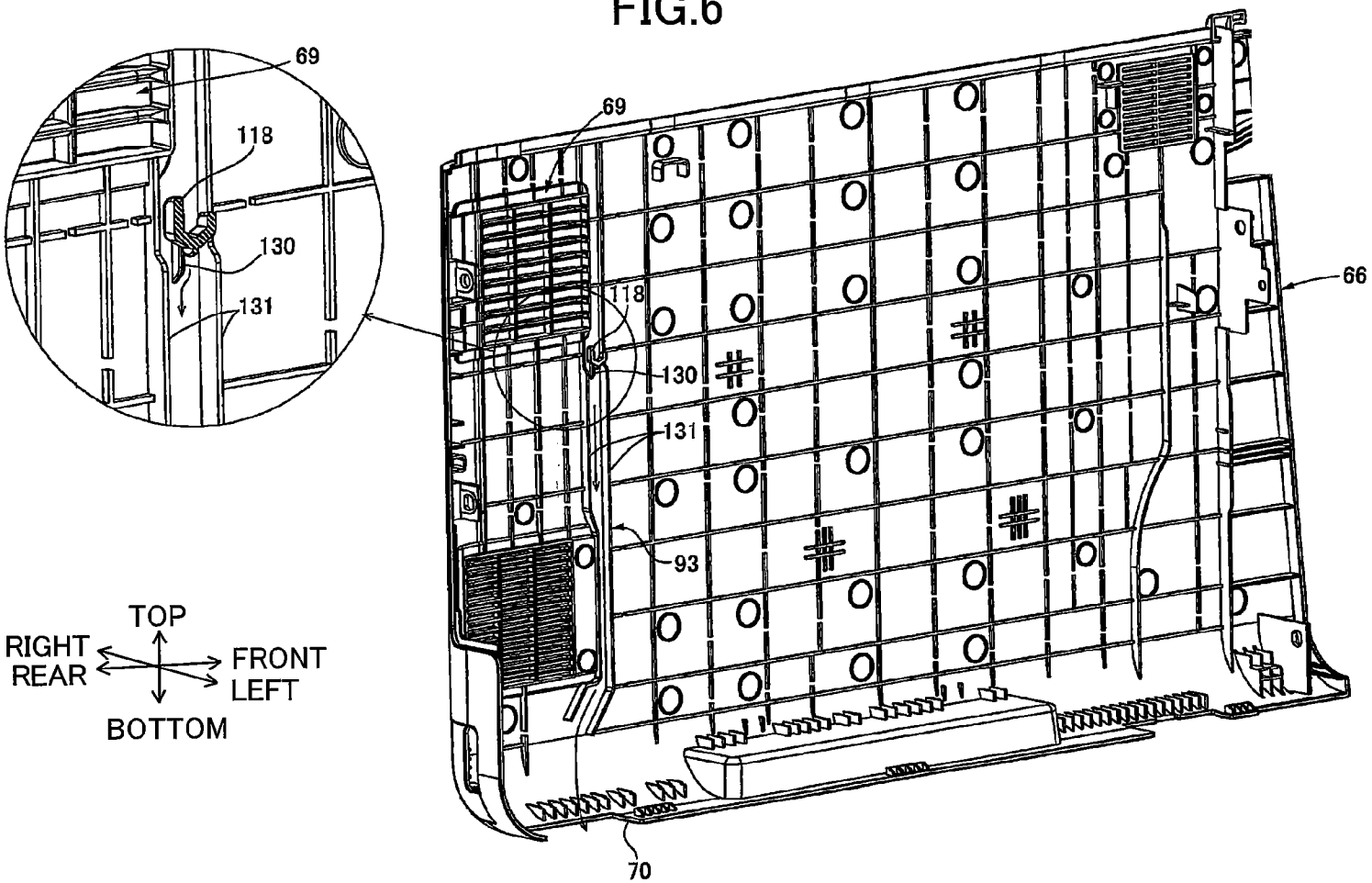
FIG. 6 is a perspective view of the side cover shown in FIG. 4 as viewed from rear left according to the embodiment of the present invention.

As shown in FIG. 6, the side cover 66 has a bottom end portion curved leftward toward the bottom edge so as to cover the bottom end portion of the frame 65.

As shown in FIGS. 4 through 6, the side cover 66 is formed with a vent 69, and a notched groove 70. The vent 69 is provided in the upper portion of the side cover 66 near the rear edge thereof so as to confront the through-hole 67 in the left-right direction with a gap therebetween. The vent 69 is configured of a plurality of openings in a grid manner.

As will be described later, the top cover 63 is further integrally provided with a third channel 93.

As shown in FIG. 4, the left wall 61 constitutes the left side of the main casing body 59 and is disposed on the left side of the image-forming unit 4 so that the image-forming unit 4 is interposed between the right wall 60 and the left wall 61 in the left-right direction. As shown in FIG. 2A, the left wall 61 has a general rectangular shape in a side view and is elongated in the front-rear direction.

As shown in FIG. 1, the rear wall 62 is disposed on the rear side of the image-forming unit 4 and constitutes the rear side of the main casing 2. The rear wall 62 connects the rear edges of the right wall 60 and the left wall 61 in the left-right direction.

As shown in FIG. 2A, the front cover 10 is disposed between the upper portion on the front edge of the right wall 60 and the upper portion on the front edge of the left wall 61.

As shown in FIGS. 1, 2A, and 2B, the top cover 63 is disposed in the top portion of the main casing 2 at a position above the image-forming unit 4.

As shown in FIGS. 2A and 2B, the top cover 63 is integrally provided with a flat plate part 80, and a first tray part 81 serving as an example of the first member of the present invention.

The flat plate part 80 has a plate shape and is generally rectangular in a plan view.

The first tray part 81 is disposed in the rear portion of the flat plate part 80 at the approximate left-right center thereof and is recessed lower than the top surface of the flat plate part 80.

The first tray part 81 includes a sheet support part 73, and a pair of first tray side walls 74.

As shown in FIG. 2B, the sheet support part 73 constitutes the bottom portion of the first tray part 81. The sheet support part 73 has a plate shape that is generally rectangular in a plan view and elongated in the left-right direction. As shown in FIG. 3, the sheet support part 73 is integrally provided with a main portion 76, and a protruding portion 77.

The main portion 76 extends continuously from the flat plate part 80 slanted downward toward the rear. The protruding portion 77 is formed continuously with the rear edge of the main portion 76, protruding downward therefrom. The protruding portion 77 extends across the entire left-right dimension of the main portion 76.

As shown in FIG. 2A, the first tray side walls 74 vertically couple the left and right edges of the main portion 76 with the bottom surface of the flat plate part 80. With this arrangement, the first tray side walls 74 are aligned with but spaced apart from each other in the left-right direction. The first tray side walls 74 have a plate shape that is generally triangular in a side view, with the apex of the triangle oriented forward.

As shown in FIGS. 2A and 3, the top cover 63 is fixed to the top end portion of the main casing body 59 so as to cover the top portions of the right wall 60, the left wall 61, and the rear wall 62. Note that the top cover 63 can be removed from the main casing body 59 in order to perform maintenance on the image-forming unit 4 and the like.

3. Duct Unit and Fan

As shown in FIG. 3, the printer 1 further includes a duct unit 64, and a fan 88.

As shown in FIG. 1, the duct unit 64 is disposed inside the main casing 2 at a position above and forward of the fixing unit 23 and above and rearward of the process unit 21.

Figure 7:
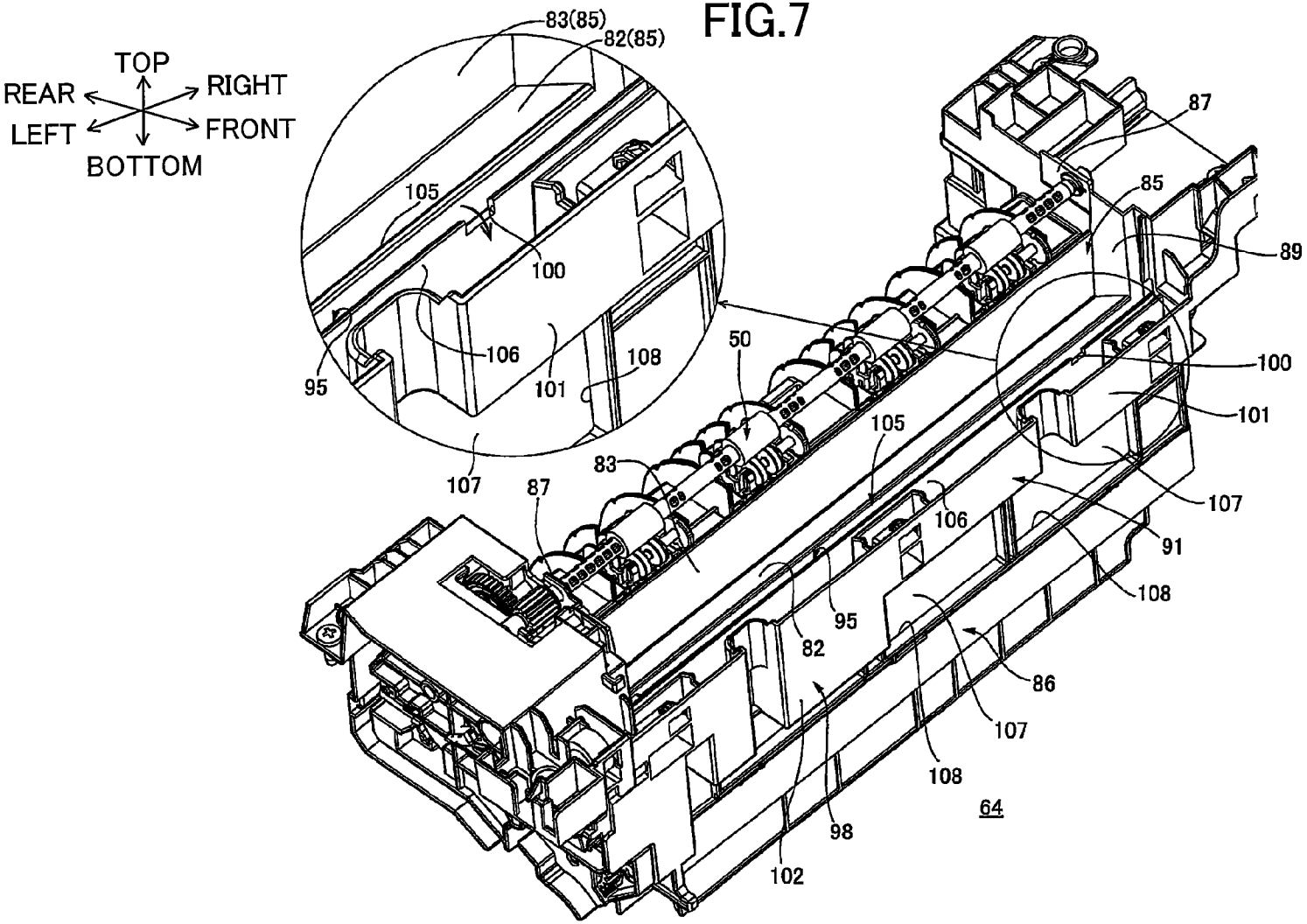
FIG. 7 is a perspective view of a duct unit shown in FIG. 3 as viewed from front left according to the embodiment of the present invention.
Figure 8:
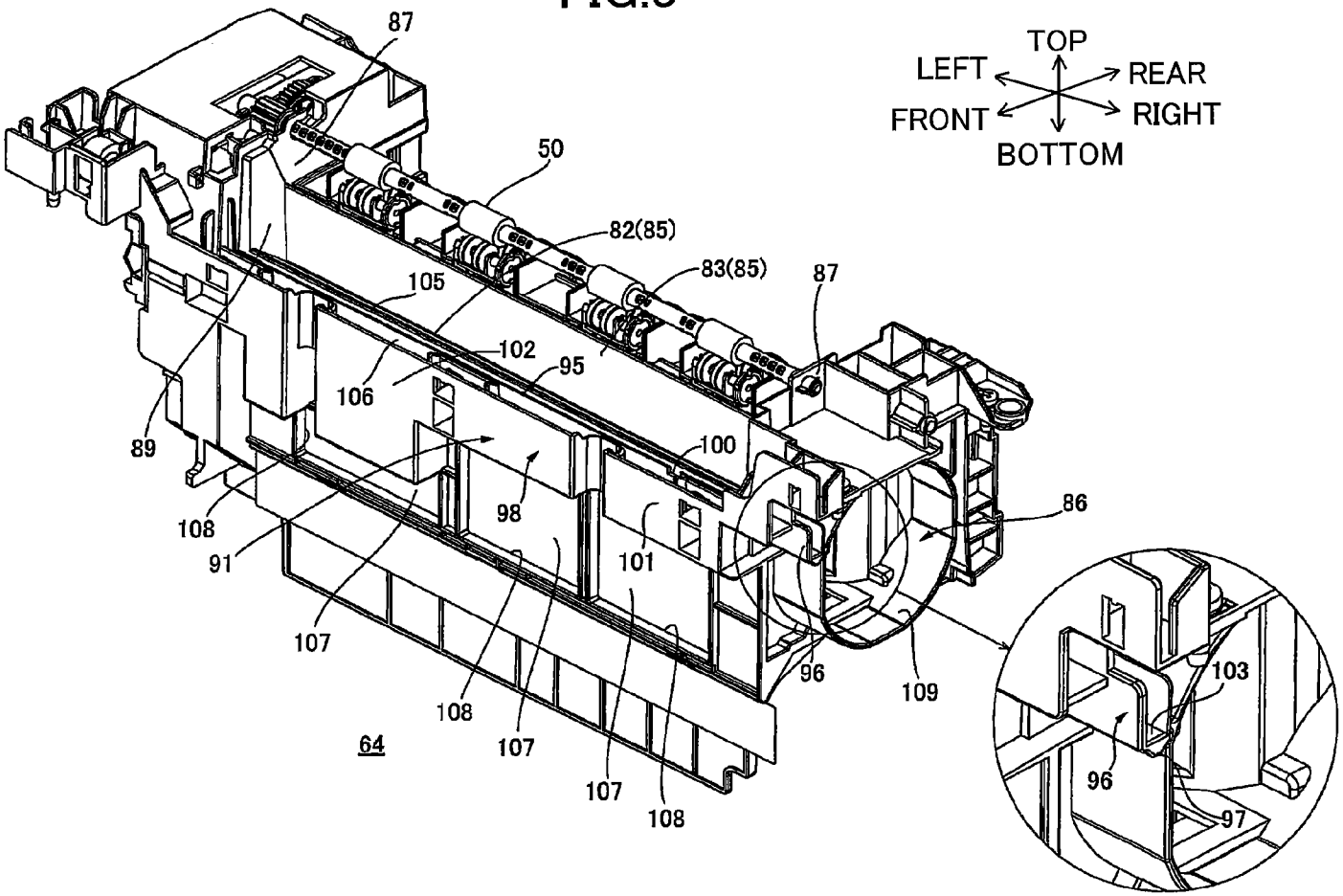
FIG. 8 is a perspective view of the duct unit shown in FIG. 3 as viewed from front right according to the embodiment of the present invention.

As shown in FIGS. 7 and 8, the duct unit 64 is integrally provided with a duct body 86 as an example of the duct in the present invention, ozone filters 107, a second tray part 85 as an example of the second member of the invention, and a pair of roller support parts 87. The top cover 63, the first tray part 81, the second tray part 85, and the top wall 71 are as an example of the cover unit of the present invention.

The duct body 86 has a box-like shape and is elongated in the left-right direction. The duct body 86 is formed with filter openings 108, and a fan opening 109.

As shown in FIG. 7, a plurality of the filter openings 108, and specifically three of the filter openings 108 in the preferred embodiment, is formed in the front wall of the duct body 86 arranged at intervals in the left-right direction. The filter openings 108 have a general rectangular shape in a front view and penetrate the front wall of the duct body 86 in the front-rear direction.

As shown in FIG. 8, the fan opening 109 is formed in the right wall of the duct body 86. The fan opening 109 has a general circular shape in a side view and penetrates the right wall of the duct body 86 in the left-right direction.

The ozone filters 107 is adapted to allow the passage of air, but trap volatile organic compounds (VOCs) contained in air passing therethrough and decompose/remove ozone. Three of the ozone filters 107 are provided to correspond to the three filter openings 108.

The ozone filters 107 are plate-shaped and generally rectangular in a front view. The ozone filters 107 are disposed on the inner front side of the duct body 86 at positions rearward of the corresponding filter openings 108. Through this arrangement, the front surfaces of the ozone filters 107 are exposed to the outside of the duct body 86 through the corresponding filter openings 108.

As shown in FIG. 3, the second tray part 85 is disposed immediately above and forward of the duct body 86. The second tray part 85 has a vertical part 83, a sloped part 82, and a pair of second tray side walls 89.

As shown in FIG. 7, the vertical part 83 has a plate shape that is generally rectangular in a front view and elongated in the left-right direction. As shown in FIG. 3, the vertical part 83 extends upward from the front end portion on the top surface of the duct body 86.

The sloped part 82 extends continuously from the bottom end portion of the vertical part 83 so as to slope upward toward the front.

As shown in FIGS. 7 and 8, the second tray side walls 89 have a plate shape that is generally rectangular in a side view and elongated vertically. The second tray side walls 89 extend upward from the respective left and right end portions on the top surface of the sloped part 82. The second tray side walls 89 face each other in the left-right direction with a space therebetween. The rear end portions of the second tray side walls 89 are connected to the respective left and right end portions on the front surface of the vertical part 83.

The roller support parts 87 are disposed on the top surface of the duct body 86 at the rear of the second tray part 85. The roller support parts 87 face each other in the left-right direction with a space therebetween. The roller support parts 87 have a plate shape that is generally rectangular in a side view and extend upward from the top surface of the duct body 86. The roller support parts 87 rotatably support the left and right ends of the discharge roller 50. Through this configuration, the discharge roller 50 is supported in the duct unit 64.

As will be described later, the duct unit 64 is integrally provided with a first channel 91.

As shown in FIG. 3, the duct unit 64 is disposed in the upper rear region of the main casing body 59 so that the front edge of the sloped part 82 in the second tray part 85 is positioned below and rearward of the rear edge of the main portion 76 in the first tray part 81, with a gap C therebetween, and the upper edge of the vertical part 83 in the second tray part 85 confronts the bottom surface of the flat plate part 80 in the top cover 63 with a discharge opening 84 formed therebetween. The gap C is an example of the neighboring portion of the present invention. The gap C is positioned over the rear end portion of the image-forming unit 4, as shown in FIG. 1. Note that the left and right sides of the duct unit 64 are supported in the left wall 61 and the right wall 60, respectively.

As shown in FIGS. 2A and 2B, the neighboring portions of the main portion 76 in the first tray part 81 and the sloped part 82 in the second tray part 85 define the gap C that extends in the left-right direction. In other words, the gap C extends orthogonally to the discharge direction X of the sheet P. Further, the region between the top edge of the vertical part 83 in the second tray part 85 and the bottom surface of the flat plate part 80 in the top cover 63 define the discharge opening 84, as shown in FIG. 3.

The second tray side walls 89 are adjacent to the corresponding first tray side walls 74 on the rear side thereof. In this way, the second tray part 85 is disposed upstream of the first tray part 81 in the discharge direction X of the sheet P. Together, the first tray part 81 and the second tray part 85 configure the discharge tray 11.

While not shown in the drawings, the fan opening 109 confronts the through-hole 67 formed in the frame 65 in the left-right direction.

As shown in FIGS. 4 and 5, the fan 88 is disposed inside the fan support part 68 at a position between the through-hole 67 and the vent 69 in the left-right direction. Accordingly, the fan 88 is positioned to the right of the duct body 86.

As illustrated in FIGS. 5, 6, and 8, the fan 88 when driven draws air into the duct body 86 through the through-hole 67 of the frame 65 and the fan opening 109 of the duct body 86 and exhausts air from the main casing 2 through the vent 69 and the side cover 66. In this way, air in the main casing 2 is introduced into the duct body 86 via the ozone filters 107 and the filter openings 108, generating a flow of air in the main casing 2 that passes through the duct body 86 and then is exhausted from the main casing 2. In other words, the duct body 86 is configured to exhaust air from the main casing 2.

4. Liquid Discharge Channel

As shown in FIG. 4, the printer 1 is provided with a liquid channel 90.

The liquid channel 90 is configured to discharge liquid from the main casing 2 that enters the main casing 2 through the gap C.

The liquid channel 90 includes a first channel 91, a second channel 92, and a third channel 93.

(1) First Channel

The first channel 91 is the upstream portion of the liquid channel 90 with respect to the direction that liquid flows. The liquid channel 90 is configured to receive liquid that enters the main casing 2 through the gap C and to guide the liquid toward the frame 65. As shown in FIG. 1, the first channel 91 is positioned vertically between the gap C and the image-forming unit 4.

As shown in FIGS. 7 and 8, the first channel 91 is integrally provided in the duct unit 64. As shown in FIG. 3, the first channel 91 is disposed adjacent to the duct body 86 and the second tray part 85 on the discharge direction X side thereof, and specifically on the upper front side of the duct body 86 and the front side of the second tray part 85. The first channel 91 is also disposed beneath the rear portion of the main portion 76 constituting the sheet support part 73. As shown in FIG. 4, the first channel 91 is disposed to the left of the frame 65.

As shown in FIGS. 3 and 4, the first channel 91 is integrally provided with a recess part 95, an extension part 96, a protrusion 97, and a reservoir part 98.

The recess part 95 is provided beneath the gap C. The recess part 95 is formed as a recess that is open on the top. The recess part 95 is elongated in the left-right direction and extends toward the frame 65 as shown in FIG. 4. As shown in FIG. 3, the recess part 95 further includes a first recess wall 105 as an example of the first wall of the present invention, a second recess wall 106 as an example of the second wall of the present invention, and a recess bottom 104 as an example of the bottom wall of the present invention.

The first recess wall 105 constitutes the rear side of the recess part 95. The first recess wall 105 extends continuously downward from the front end portion of the sloped part 82 in the second tray part 85. Accordingly, the first recess wall 105 is disposed upstream of the protruding portion 77 in the discharge direction X, i.e., to the rear of the protruding portion 77, and confronts the protruding portion 77 in the front-rear direction while being separated therefrom.

As shown in FIG. 4, the first recess wall 105 has a plate shape that is generally trapezoidal in a front view, growing wider toward the right. Specifically, the top edge of the first recess wall 105 extends in the left-right direction, while the bottom edge of the first recess wall 105 extends in a direction sloping from the upper left to the lower right. Note that the bottom portion of the first recess wall 105 is positioned lower than the bottom edge of the protruding portion 77.

As shown in FIG. 3, the second recess wall 106 constitutes the front side of the recess part 95. The second recess wall 106 is disposed downstream from the protruding portion 77 in the discharge direction X, i.e., on the front side of the protruding portion 77 while being separated therefrom. The second recess wall 106 confronts the protruding portion 77 in the front-rear direction. The second recess wall 106 has the same shape and size as the first recess wall 105 and is aligned with the first recess wall 105 in the front-rear direction.

As shown in FIG. 7, the second recess wall 106 is formed with a communication groove 100 as an example of the communication part of the present invention. The communication groove 100 is formed in the top edge of the second recess wall 106 near the right end thereof, and specifically is provided at a position approximately one-sixth the left-right dimension of the second recess wall 106 from the right end of the same. In other words, the communication groove 100 is provided in the right portion of the recess part 95. The communication groove 100 has a general rectangular shape in a front view and is recessed downward from the top edge of the second recess wall 106.

As shown in FIG. 3, the recess bottom 104 constitutes the bottom of the recess part 95 and bridges the bottom end portions of the first recess wall 105 and the second recess wall 106. With this configuration, the recess bottom 104 is disposed beneath the protruding portion 77 and vertically confronts the protruding portion 77 with a gap therebetween. Thus, the protruding portion 77 is disposed inside the recess part 95 and protrudes toward the recess bottom 104 of the recess part 95.

As shown in FIG. 4, the recess bottom 104 extends in a direction sloping from the upper left toward the lower right. In other words, the recess bottom 104 is slanted downward from left to right.

Further, the left end of the recess part 95 is closed, while the right end thereof is open.

The right end of the recess part 95, and specifically the right edges of the first recess wall 105, the second recess wall 106, and the recess bottom 104, defines a liquid outlet 99. Thus, the recess bottom 104 slopes so as to grow lower toward the liquid outlet 99.

Further, the liquid outlet 99 is provided at the right end of the recess part 95 and is positioned further rightward than the image-forming unit 4. The liquid outlet 99 has a general U-shape in a side view with the opening of the "U" facing upward.

The extension part 96 is disposed adjacent to the recess part 95 on the right side thereof. Specifically, as shown in FIG. 4, the extension part 96 is offset from the image-forming unit 4 in a plan view such that the first channel 91 extends outward of the image-forming unit 4 to guide liquid outside of the image-forming unit 4. In other word, the extension part 96 has a left end portion in communication with the liquid outlet 99 and a right end portion in left-right direction. The side cover 66 is closer to the right end portion of the extension part 96 than to the image forming unit 4 in the left-right direction. As shown in FIG. 8, the extension part 96 has a general U-shape in a side view with the opening of the "U" facing upward. The extension part 96 extends continuously rightward from the right end of the recess part 95.

As shown in FIG. 4, the extension part 96 has an extension part bottom wall 103 that constitutes the bottom of the extension part 96. The extension part bottom wall 103 extends continuously downward and rightward from the right edge of the recess bottom 104 constituting the recess part 95 and follows the same slope as the recess bottom 104. Accordingly, the top surface of the extension part bottom wall 103 is substantially flush with the top surface of the recess bottom 104.

The interior space of the extension part 96 is in communication with the liquid outlet 99 in the left-right direction and communicates with the interior space of the recess part 95 through the liquid outlet 99.

As shown in FIG. 8, the protrusion 97 protrudes continuously downward from the right edge of the extension part bottom wall 103. The protrusion 97 is plate-like with a general trapezoidal shape in a side view, growing narrower toward the bottom.

The reservoir part 98 is disposed adjacent to the recess part 95 on the front side thereof. As shown in FIG. 3, the reservoir part 98 has a box-like shape that is open on the top. The top end portion on the rear wall of the reservoir part 98 is connected to the front end portion on the bottom surface of the recess bottom 104.

The front wall of the reservoir part 98 has a greater vertical dimension than the rear wall of the reservoir part 98. Hence, the front wall of the reservoir part 98 has an upper portion positioned to the front of and spaced apart from the second recess wall 106 so as to oppose the second recess wall 106 in the front-rear direction. Accordingly, as shown in FIG. 7, the front surface of the second recess wall 106 faces the interior space of the reservoir part 98, and the communication groove 100 allows communication in the front-rear direction between the interior space of the recess part 95 and the interior space of the reservoir part 98.

As shown in FIG. 8, the reservoir part 98 includes a first reservoir part 101, and a second reservoir part 102.

The first reservoir part 101 constitutes the right portion of the reservoir part 98. The first reservoir part 101 is in communication with the interior space of the recess part 95 through the communication groove 100.

The second reservoir part 102 constitutes the left portion of the reservoir part 98 and is adjacent to the first reservoir part 101 on the left side thereof. The second reservoir part 102 is in communication with the first reservoir part 101 in the left-right direction. The second reservoir part 102 has a greater vertical dimension than the first reservoir part 101.

(2) Second Channel

As shown in FIG. 4, the second channel 92 constitutes the middle portion of the liquid channel 90 along the direction that liquid flows. The second channel 92 is configured to receive liquid from the first channel 91 and to guide the received liquid toward the third channel 93.

As shown in FIGS. 4 and 5, the second channel 92 is formed in the frame 65. The second channel 92 includes an inlet 110, a liquid receiving part 111 and a guiding part 112.

As shown in FIG. 5, the inlet 110 as an example of the passage opening of the present invention is provided on the front side of the through-hole 67. The inlet 110 has a general rectangular shape in a side view and passes through the frame 65 in the left-right direction.

As shown in FIG. 4, the liquid receiving part 111 is provided on the left surface of the frame 65 at a position below the protrusion 97. The liquid receiving part 111 protrudes leftward from the bottom peripheral edge of the inlet 110 toward the liquid outlet 99. More specifically, the liquid receiving part 111 is integrally provided with a receiving wall 113, and a pair of coupling walls 114.

The receiving wall 113 constitutes the bottom of the liquid receiving part 111. The receiving wall 113 has a plate shape that is generally L-shaped in a side view. Specifically, the receiving wall 113 first extends leftward from the bottom edge of the inlet 110, then bends and extends upward.

The coupling walls 114 constitute the front and rear sides of the liquid receiving part 111 and are disposed apart from each other in the front-rear direction. The coupling walls 114 are plate-shaped and have a general rectangular shape in a front view. The inner front-rear surfaces of the coupling walls 114 at their bottom and left edges are respectively connected to the front and rear edges of the receiving wall 113. The right edges of the coupling walls 114 are connected to peripheral edges of the inlet 110.

Through this configuration, the bottom portion of the inlet 110 and the liquid receiving part 111 are in communication with each other in the left-right direction.

As shown in FIG. 5, the guiding part 112 is disposed on the right surface of the frame 65 and is adjacent to the front side of the fan support part 68. The right surface of the frame 65 is an example of the cover-side surface of the present invention. Specifically, the guiding part 112 is disposed between the side cover 66 and the first channel 91 in the left-right direction. The guiding part 112 includes a pair of first guiding walls 117, and a closing wall 118 as an example of the closing part in the present invention.

One of the first guiding walls 117 is disposed on each of the front and rear sides of the inlet 110 so that the inlet 110 is interposed therebetween when viewed from the right. The first guiding walls 117 protrude rightward from the right surface of the frame 65 and are separated from each other in the front-rear direction. The first guiding walls 117 include a front first guiding wall 117F and a rear first guiding wall 117R.

The front first guiding wall 117F is integrally provided with a straight portion 119, and a sloped portion 120.

In a side view, the straight portion 119 extends linearly along the vertical direction. The straight portion 119 has a top end portion positioned on the right of the inlet 110.

The sloped portion 120 is formed continuously with the bottom edge of the straight portion 119 and slopes rearward toward the bottom. While not shown in the drawings, a power supply board is provided on the right surface of the frame 65 in front of the front first guiding wall 117F for supplying power to the image-forming unit 4. Hence, the sloped portion 120 slopes away from the power supply board.

The rear first guiding wall 117R constitutes the front wall of the fan support part 68, as described above, and extends linearly along the vertical in a side view. The top end portion of the rear first guiding wall 117R is positioned on the rear side of the inlet 110 in a side view. The vertical dimension of the rear first guiding wall 117R is approximately equivalent to the vertical dimension of the straight portion 119.

The closing wall 118 is disposed adjacent to the bottoms of the first guiding walls 117. That is, the closing wall 118 is positioned lower than the fan support part 68 and, hence, is positioned lower than the fan 88.

The closing wall 118 has a general U-shape in a side view, with the opening of the "U" facing upward. The closing wall 118 protrudes rightward from the right surface of the frame 65.

As shown in FIG. 4, the closing wall 118 has a greater left-right dimension than the left-right dimension of the first guiding walls 117. The right portion of the closing wall 118 protrudes farther rightward than the first guiding walls 117.

As shown in FIG. 5, the left portion of the front wall of the closing wall 118 is connected at its top end portion to the bottom end portion of the sloped portion 120 constituting the front first guiding wall 117F, and the left portion of the rear wall of the closing wall 118 is connected at its top end portion to the bottom end portion of the rear first guiding wall 117R. Through this configuration, the closing wall 118 is coupled to the bottom end portions of both first guiding walls 117.

(3) Third Channel

As shown in FIGS. 4 and 6, the third channel 93 constitutes the downstream portion of the liquid channel 90 in the direction that liquid flows therethrough. The third channel 93 is configured to receive liquid from the second channel 92 and to guide the liquid out of the main casing 2 through the notched groove 70.

As shown in FIG. 6, the third channel 93 is integrally provided on the side cover 66, and specifically on the left surface of the side cover 66. The third channel 93 includes a rib 130 as an example of the protruding part in the present invention, and a pair of second guiding walls 131.

The rib 130 is disposed on the left surface of the side cover 66 at a position on the lower front side of the vent 69. The rib 130 extends linearly along the vertical in a side view and has a general plate shape that protrudes leftward from the left surface of the side cover 66. The left end of the rib 130 and the right end on the bottom edge of the closing wall 118 face each other in the left-right direction with a slight gap therebetween.

The second guiding walls 131 are respectively arranged on each of the front and rear sides of the rib 130 so that the rib 130 is interposed between the second guiding walls 131 in a left side view. The second guiding walls 131 protrude leftward from the left surface of the side cover 66 and are separated from each other in the front-rear direction.

More specifically, the rib 130 is disposed between the upper end portions of the second guiding walls 131, with the upper end portions of the second guiding walls 131 aligned with the upper end of the rib 130 in the front-rear direction with gaps therebetween.

The bottom portions of the second guiding walls 131 slope rearward toward the bottom, such that the bottom ends of the second guiding walls 131 are positioned above the notched groove 70 with a space therebetween.

5. Liquid-Guiding Function

As illustrated by the printer 1 in FIGS. 2A, 2B, and 3, if the user accidentally spills water or other liquid over the top of the main casing 2, the liquid lands on the top surface of the top wall 71 constituting the main casing 2.

If this occurs, liquid may enter the gap C formed between the main portion 76 of the sheet support part 73 and the sloped part 82 of the second tray part 85 shown in FIG. 3. Liquid that enters the gap C flows down along the protruding portion 77 and drops from the bottom end of the protruding portion 77 onto the top surface of the recess bottom 104 constituting the recess part 95.

As shown in FIG. 4, liquid falling onto the recess bottom 104 flows rightward along the sloped recess bottom 104. In other words, the recess part 95 receives liquid that penetrates the main casing 2 through the gap C and guides that liquid rightward.

Once the liquid reaches the right end of the recess part 95, the liquid is discharged from the recess part 95 through the liquid outlet 99. If the flow of liquid in the recess part 95 increases until the surface of the liquid rises above the bottom edge of the communication groove 100 at this time, some of the liquid flows through the communication groove 100 into the first reservoir part 101 of the reservoir part 98 and is retained therein, as shown in FIG. 7.

Further, liquid discharged from the recess part 95 through the liquid outlet 99 enters the extension part 96 that communicates with the liquid outlet 99 and flows along the top surface of the extension part bottom wall 103 constituting the extension part 96 that slopes diagonally downward and rightward. Subsequently, the liquid flows over the right edge of the extension part 96 down along the protrusion 97 and falls onto the liquid receiving part 111 of the second channel 92.

The receiving wall 113 of the liquid receiving part 111 receives liquid flowing down from the protrusion 97. The liquid receiving part 111 guides the liquid to flow rightward toward the inlet 110.

The liquid passes through the inlet 110 from left to right. With this configuration, the liquid receiving part 111 and the inlet 110 guide liquid transferred through the first channel 91 to the side of the frame 65 opposite the image-forming unit 4.

As shown in FIG. 5, liquid passing through the inlet 110 is guided by the pair of first guiding walls 117 to flow downward along the right surface of the frame 65 in the flow direction Y. When the liquid reaches the closing wall 118 constituting the bottom end of the guiding part 112, the liquid flows along the bottom wall of the closing wall 118, changing the direction of flow from the flow direction Y to the right. Hence, the closing wall 118 is disposed on the downstream ends of the first guiding walls 117 in the flow direction Y and is coupled to these downstream ends.

As shown in FIG. 6, when the liquid subsequently reaches the right end of the closing wall 118, the liquid is transferred from the closing wall 118 to the rib 130. The liquid flows down along the rib 130 and is guided by the pair of second guiding walls 131 to flow downward along the left surface of the side cover 66.

Next, the liquid is discharged from the bottom edges of the second guiding walls 131, flows downward toward the notched groove 70 and is discharged from the main casing 2 through the notched groove 70.

6. Operational Advantages (1) As shown in FIG. 3, the first channel 91 in the printer 1 has the recess part 95 disposed below the gap C formed between neighboring portions of the first tray part 81 and the second tray part 85. Hence, liquid applied to the top of the top wall 71 constituting the main casing 2 is received by the recess part 95 if the liquid enters the main casing body 59 through the gap C. As illustrated in FIG. 4, the recess part 95 can guide the liquid toward the frame 65. As shown in FIG. 4, after liquid is guided by the recess part 95 toward the frame 65, the liquid is discharged toward the frame 65 through the liquid outlet 99. Liquid discharged from the liquid outlet 99 passes from left to right through the inlet 110 toward the frame 65 and is received in the second channel 92 provided in the frame 65.

That is, liquid that enters the main casing body 59 through the gap C is first received in the recess part 95. After flowing toward the frame 65 through the recess part 95, the liquid is guided to the opposite side of the image-forming unit 4 with respect to the frame 65 through the inlet 110 and is then transferred to the second channel 92.

Accordingly, the structure of the invention can reliably prevent the image-forming unit 4 and the like from becoming wet, even if liquid enters the main casing body 59 through the gap C.

(2) As shown in FIG. 6, the side cover 66 provided adjacent to the frame 65 on the right side thereof is provided with the third channel 93. Hence, liquid guided into the second channel 92 is subsequently transferred to the third channel 93 after being guided to the opposite side of the image-forming unit 4 with respect to the frame 65 through the inlet 110, as shown in FIGS. 5 and 6. The third channel 93 then guides liquid received from the second channel 92 to the outside of the main casing body 59.

As a result, liquid penetrating the main casing body 59 through the gap C can be discharged from the main casing body 59 through the first channel 91, the second channel 92, and the third channel 93. Accordingly, this structure can reliably prevent the image-forming unit 4 and the like from becoming wet.

(3) As shown in FIG. 4, the extension part 96 guides liquid discharged through the liquid outlet 99 rightward, i.e., toward the frame 65. In this way, liquid discharged from the liquid outlet 99 can be reliably received in the second channel 92 provided in the frame 65.

(4) As shown in FIG. 4, the liquid outlet 99 is provided on the right end portion of the recess part 95 and is positioned farther rightward than the image-forming unit 4. Accordingly, liquid received in the recess part 95 is guided in the recess part 95 to a position that is offset from the image-forming unit 4 in a plan view and is then subsequently discharged from the recess part 95 through the liquid outlet 99.

Accordingly, the structure of the invention can reliably prevent the image-forming unit 4 from becoming wet by liquid discharged through the liquid outlet 99.

(5) As shown in FIG. 4, liquid discharged through the liquid outlet 99 flows along the extension part 96 and subsequently drops off the extension part 96 and flows down along the protrusion 97. Thus, liquid discharged through the liquid outlet 99 can be guided reliably toward the second channel 92.

(6) As shown in FIG. 4, the liquid receiving part 111 is provided beneath the protrusion 97. The liquid receiving part 111 can reliably receive liquid flowing down along the protrusion 97. Since the liquid receiving part 111 is in communication with the inlet 110, liquid received by the liquid receiving part 111 can be reliably guided toward the inlet 110.

(7) As shown in FIG. 5, the second channel 92 has the pair of first guiding walls 117. The first guiding walls 117 guide liquid passing through the inlet 110 along the right surface of the frame 65 to a prescribed position. The closing wall 118 coupled to the downstream end portions of the first guiding walls 117 in the flow direction Y subsequently changes the direction of flow to transfer the liquid to the third channel 93.

Accordingly, this construction can reliably guide liquid along the right surface of the frame 65 after the liquid has passed through the inlet 110 and can reliably transfer liquid from the guiding part 112 to the third channel 93.

(8) As shown in FIG. 6, the rib 130 confronts the guiding part 112 in the left-right direction. With this configuration, liquid guided through the guiding part 112 is transferred from the guiding part 112 to the third channel 93 along the rib 130. Subsequently, the pair of second guiding walls 131 guide the liquid along the left surface of the side cover 66 toward the outside of the main casing body 59.

As a result, this construction can stably transfer liquid from the guiding part 112 to the third channel 93 and can reliably guide that liquid out of the main casing body 59.

(9) As shown in FIG. 6, the rib 130 is adjacent to the right edge of the closing wall 118 on the right side thereof. Thus, after the closing wall 118 changes the direction in which liquid flows, the liquid can be stably transferred along the rib 130 from the guiding part 112 to the third channel 93. Accordingly, this construction can transfer liquid from the guiding part 112 to the third channel 93 with reliability.

(10) As shown in FIG. 3, the printer 1 is provided with the duct body 86 and the fan 88. By driving the fan 88, air in the main casing body 59 can be exhausted from the main casing body 59 through the duct body 86. In this way, heat can be efficiently dissipated from the printer 1.

Since the duct unit 64 is integrally provided with the duct body 86 and the first channel 91, fewer parts are required in this structure in comparison with a case where the duct body 86 and the first channel 91 were provided separately.

(11) As shown in FIG. 5, the closing wall 118 is provided lower than the fan 88. This configuration suppresses any influence that the flow of air driven by the fan 88 affects liquid when the closing wall 118 changes the flow direction F. As a result, liquid can be more stably transferred from the closing wall 118 to the third channel 93.

(12) As shown in FIG. 3, the printer 1 is provided with the duct body 86 and the fan 88. Since the duct unit 64 is integrally provided with the duct body 86 and the first channel 91, fewer parts are required in this structure in comparison with a case where the duct body 86 and the first channel 91 were provided separately.

(13) As shown in FIG. 3, the discharge tray 11 that supports sheets P after the sheets P have been discharged from the sheet-discharge unit 5 is supported on the main casing body 59 above the image-forming unit 4. This arrangement provides easy access to sheets P discharged from the sheet-discharge unit 5.

Further, the first tray part 81 constituting part of the discharge tray 11 can be removed from the main casing body 59. Accordingly, maintenance on the image-forming unit 4 is facilitated simply by removing the first tray part 81 from the main casing body 59.

(14) As shown in FIG. 3, the recess part 95 has the recess bottom 104 constituting the bottom of the recess part 95. Liquid that enters the main casing body 59 through the gap C is received on the recess bottom 104 and flows along the recess bottom 104, as indicated in FIG. 4. Here, the recess bottom 104 is sloped downward toward the liquid outlet 99. Accordingly, the recess bottom 104 can reliably guide liquid received on the recess part 95 toward the liquid outlet 99 and can reliably discharge liquid from the recess part 95 through the liquid outlet 99.

(15) As shown in FIG. 3, the first tray part 81 has the protruding portion 77 that protrudes toward and into the recess part 95. Accordingly, liquid that enters the main casing body 59 through the gap C flows along the protruding portion 77 before dropping onto the recess bottom 104 of the recess part 95.

(16) As shown in FIG. 7, the duct unit 64 is integrally provided with the first channel 91 and the second tray part 85. Thus, fewer parts are required in this structure than if the first channel 91 and second tray part 85 were provided separately.

(17) As shown in FIG. 2A, the discharge tray 11 in the printer 1 is configured from the first tray part 81 and the second tray part 85. Consequently, the gap C is formed between the neighboring portions of the first tray part 81 and the second tray part 85. Hence, liquid applied to the top of the discharge tray 11 may enter the main casing body 59 through the gap C.

However, since the recess part 95 of the first channel 91 is disposed beneath the gap C, as shown in FIG. 3, the recess part 95 receives liquid that enters the main casing body 59 through the gap C. As illustrated in FIG. 4, the recess part 95 can guide liquid received therein rightward to the prescribed position, after which liquid is discharged from the recess part 95 through the liquid outlet 99.

If the flow of liquid entering the main casing body 59 increases, causing the level of the liquid flowing in the recess part 95 to increase, the surface of the liquid flowing in the recess part 95 may rise above the bottom edge of the communication groove 100 shown in FIG. 7. If this occurs, some of the liquid flows through the communication groove 100 and is collected in the first reservoir part 101 of the reservoir part 98.

Thus, liquid entering the main casing body 59 through the gap C is received by the recess part 95 and then discharged through the liquid outlet 99 at a prescribed position. Even if the flow of liquid in the recess part 95 increases, the liquid passes through the communication groove 100 and is collected in the reservoir part 98. Thus, this configuration reliably prevents the image-forming unit 4 and the like from becoming wet.

(18) As shown in FIG. 7, the communication groove 100 is provided in the right side of the recess part 95. Hence, both the communication groove 100 and the liquid outlet 99 are provided on the right portion of the recess part 95. Therefore, by guiding liquid toward the right, the recess part 95 can discharge the liquid through the liquid outlet 99 and can collect excess liquid in the reservoir part 98 through the communication groove 100. Thus, this construction can reliably discharge and collect liquid that enters the main casing body 59.

The recess part 95 also has the first recess wall 105 and the second recess wall 106 each disposed on opposite sides of the protruding portion 77 with respect to the discharge direction X. Accordingly, the recess part 95 can reliably receive liquid that flows down the protruding portion 77 into the recess part 95.

(19) As shown in FIG. 8, the reservoir part 98 has the first reservoir part 101 and second reservoir part 102. This structure increases the quantity of liquid that the reservoir part 98 can collect.

(20) As shown in FIG. 3, the printer 1 includes the duct body 86 and the fan 88. By driving the fan 88, air in the main casing 2 can be exhausted from the main casing 2 through the duct body 86. In this way, heat can be efficiently dissipated from the printer 1.

Further, the first reservoir part 101 provided relatively near the fan 88 has a smaller vertical dimension than the second reservoir part 102. This allows the reservoir part 98 to be provided with both the first reservoir part 101 and the second reservoir part 102, while ensuring a smooth flow of air near the fan 88. Thus, heat can be efficiently dissipated from the printer 1 while increasing the quantity of liquid that the reservoir part 98 can retain.

What is claimed is:

1. An image forming apparatus comprising:

a casing comprising a frame supporting an image forming unit configured to form an image on a recording medium; and a cover unit disposed above the image forming unit and comprising a first member, a second member positioned adjacent thereto, and a neighboring portion positioned between the first member and the second member and over the image forming unit; and a liquid channel configured to guide liquid that has entered the casing and comprising:

a first channel disposed between the neighboring portion and the image forming unit and configured to receive liquid that has entered the casing through the neighboring portion and guide the liquid to the frame, the first channel comprising:

a recess part disposed below the neighboring portion and extending toward the frame in an extending direction; and a liquid outlet configured to discharge the liquid from the recess part and positioned at an end portion of the recess part in the extending direction; and a second channel disposed at the frame and configured to receive the liquid from the first channel, the second channel having a passage opening through the frame in the extending direction and configured to allow the liquid discharged from the liquid outlet to pass through the frame in the extending direction.

2. The image forming apparatus according to claim 1, further comprising a cover disposed adjacent to the frame and covering the frame from an opposite side of the image forming unit with respect to the frame in the extending direction, wherein the liquid channel further comprises a third channel configured to receive the liquid from the second channel and guide the liquid outside the casing, the third channel being provided at the cover.

3. The image forming apparatus according to claim 1, further comprising a cover disposed adjacent to the frame and covering the frame from an opposite side of the image forming unit with respect to the frame in the extending direction, wherein the first channel comprises an extension part extending from the liquid outlet toward the cover and in communication with the liquid outlet.

4. The image forming apparatus according to claim 3, wherein the extension part has one end portion in communication with the liquid outlet and another end portion opposite to the one end portion in the extending direction, wherein the cover is closer to the another end portion of the extension part than to the image forming unit in the extending direction.

5. The image forming apparatus according to claim 3, wherein the extension part has a bottom end portion, wherein the first channel comprises a protrusion protruding downward from the bottom end portion of the extension part.

6. The image forming apparatus according to claim 5, wherein the second channel comprises a receiving part extending toward the liquid outlet in the extending direction, the receiving part being disposed under the protrusion and in communication with the second channel.

7. The image forming apparatus according to claim 3, wherein the frame has a cover-side surface facing the cover, wherein the second channel comprises a guiding part disposed on the cover-side surface of the frame, the guiding part comprising:

a pair of first guiding walls disposed at both sides of the passage opening as viewed from the extending direction so as to sandwich the passage opening, each of the first guiding walls having a downstream end portion in a flow direction of the liquid; and a closing part disposed at the downstream end portion of the pair of first guiding walls and connecting the downstream end portions of the first guiding walls with each other.

8. The image forming apparatus according claim 7, wherein the liquid channel further comprises a third channel configured to receive the liquid from the second channel and guide the liquid outside the casing, the third channel being provided at the cover, wherein the third channel comprises:

a protruding part facing the guiding part in the extending direction and protruding from the cover in the extending direction; and a pair of second guiding walls disposed at both sides of the protruding part as viewed from the extending direction so as to sandwich the protruding part.

9. The image forming apparatus according to claim 8, wherein the protruding part is disposed adjacent to the closing part in the extending direction.

10. The image forming apparatus according to claim 8, further comprising:

a duct configured to discharge air from the casing to an outside of the casing; and a fan configured to cause the air in the duct to flow, the duct and the first channel being integrally formed with each other.

11. The image forming apparatus according to claim 10, wherein the fan faces the cover in the extending direction, and the closing part is positioned lower than the fan.

12. The image forming apparatus according to claim 1, further comprising:

a duct configured to discharge air from the casing to an outside of the casing; and a fan configured to cause the air in the duct to flow, the duct and the first channel being integrally formed with each other.

13. The image forming apparatus according to claim 1, further comprising:

a discharge unit configured to discharge the recording medium on which the image has been formed by the image forming unit to an outside of the casing in a discharge direction perpendicular to a vertical direction and the extending direction; and a tray unit comprising the first member and the second member and configured to support the recording medium discharged from the discharge unit, wherein the first member is disposed downstream of the second member in the discharge direction, wherein the neighboring portion is a gap extending in the extending direction.

14. The image forming apparatus according to claim 13, wherein the recess part has a bottom end portion provided with a bottom wall, wherein the bottom wall is sloped downward toward the liquid outlet.

15. The image forming apparatus according to claim 14, wherein the first member comprises a protruding portion extending in the extending direction and disposed in the recess part, the protruding portion protruding toward the bottom wall, wherein the recess part comprises:

a first wall disposed at an upstream side of the protruding portion in the discharge direction so as to face the protruding portion with a gap between the protruding portion and the first wall; and a second wall disposed at a downstream side of the protruding portion in the discharge direction so as to face the protruding portion with a gap between the protruding portion and the second wall.

16. The image forming apparatus according to claim 15, wherein the recess part and the second member are integrally formed with each other.

17. The image forming apparatus according to claim 13, further comprising:

a reservoir part configured to accommodate therein liquid and disposed adjacent to the recess part; and a communication part providing a communication between the recess part and the reservoir part.

18. The image forming apparatus according to claim 17, wherein the recess part has another end portion opposite to the end portion in the extending direction, wherein the communication part is disposed closer to the end portion than to the another end portion.

19. The image forming apparatus according to claim 17, wherein the reservoir part comprises:

a first reservoir part in communication with the communication part; and a second reservoir part in communication with the first reservoir part and disposed adjacent to the first reservoir part at an opposite side of the liquid outlet with respect to the first reservoir part in the extending direction, wherein the first reservoir part has a vertical length in the vertical direction smaller than a vertical length in the vertical direction of the second reservoir part.

20. The image forming apparatus according to claim 19, further comprising:

a duct configured to discharge air from the casing to an outside of the casing, the duct being disposed adjacent to the recess part in the discharge direction; and a fan configured to cause the air in the duct to flow, the fan being disposed at a side opposite to the image forming unit with respect to the frame in the extending direction.

* * * * *